US009267284B2

(12) United States Patent
Shaw

(10) Patent No.: US 9,267,284 B2
(45) **Date of Patent: *Feb. 23, 2016**

(54) DECORATIVE CONCRETE AND METHOD OF INSTALLING THE SAME

(71) Applicant: LITHOCRETE, INC., Costa Mesa, CA (US)

(72) Inventor: Ronald D. Shaw, Corona Del Mar, CA (US)

(73) Assignee: Lithocrete, Inc., Costa Mesa, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/177,846

(22) Filed: Feb. 11, 2014

(65) Prior Publication Data

US 2014/0157719 A1 Jun. 12, 2014

Related U.S. Application Data

(63) Continuation of application No. 13/595,834, filed on Aug. 27, 2012, now Pat. No. 8,684,627, which is a continuation of application No. 12/357,274, filed on Jan. 21, 2009, now abandoned.

(51) Int. Cl.

| | |
|---|---|
| ***E04G 21/10*** | (2006.01) |
| ***E04C 2/06*** | (2006.01) |
| ***E04F 15/12*** | (2006.01) |
| ***E04F 21/24*** | (2006.01) |
| ***E02D 27/32*** | (2006.01) |
| ***E04B 1/66*** | (2006.01) |

(Continued)

(52) U.S. Cl.

CPC . *E04C 2/06* (2013.01); *E02D 27/32* (2013.01); *E04B 1/66* (2013.01); *E04F 15/12* (2013.01); *E04F 21/04* (2013.01); *E04F 21/161* (2013.01); *E04F 21/24* (2013.01); *E04G 21/10* (2013.01)

(58) Field of Classification Search

USPC ..... 404/75
IPC ..... E04G 21/10
See application file for complete search history.

(56) References Cited

U.S. PATENT DOCUMENTS

| | | | |
|---|---|---|---|
| 348,443 | A | 8/1886 | Anderson |
| 745,068 | A | 11/1903 | Menczarski |
| 774,005 | A | 11/1904 | Thies |

(Continued)

OTHER PUBLICATIONS

Sinak Corporation; "Product Information Sheet, Sinak Sealers HLQ-625, HLQ-125, HLQ-250, General Applications"; Jan. 1994; 2 pgs.

(Continued)

*Primary Examiner* — Gary Hartmann
(74) *Attorney, Agent, or Firm* — Stetina Brunda Garred & Brucker

(57) ABSTRACT

A decorative concrete product and method of making the same is provided. The concrete surface carries a unique textural and visual decorative pattern that is troweled over the uncured surface. The decorative pattern strategically conceals any imperfections in the concrete surface. A decorative finishing tool is utilized to create a unique and consistent pattern throughout the exposed surface of the concrete. Unique visual patterns may include any aesthetic design including wood grain, or lightly finished honed or cut stone. The decorative finishing tool may be configured so that varying textures and contours may consistently be imprinted throughout the concrete. Advantageously, the cured concrete retains the durability of a concrete surface while carrying a visually and texturally appealing appearance.

18 Claims, 3 Drawing Sheets

(51) Int. Cl.
*E04F 21/16* (2006.01)
*E04F 21/04* (2006.01)

(56) References Cited

U.S. PATENT DOCUMENTS

| | | | |
|---|---|---|---|
| 821,277 | A | 5/1906 | Bellars |
| 828,031 | A | 8/1906 | Kemper |
| 830,747 | A | 9/1906 | Stauffer |
| 836,369 | A | 11/1906 | Dexter |
| 958,194 | A | 5/1910 | Thomas |
| 967,836 | A | 8/1910 | Rodman |
| 969,435 | A | 9/1910 | Adamson |
| 1,397,678 | A | 11/1921 | Paoli |
| 1,534,353 | A | 4/1925 | Besser |
| 1,728,936 | A | 9/1929 | Johnson |
| 2,021,210 | A | 11/1935 | Thorn |
| 2,101,540 | A | 12/1937 | Gullich |
| 2,172,629 | A | 9/1939 | Treuhaft |
| 2,200,433 | A | 5/1940 | Ripley |
| 2,275,272 | A | 3/1942 | Scripture |
| 2,277,203 | A | 3/1942 | Boult |
| 2,296,453 | A | 9/1942 | Saffert |
| 2,476,465 | A | 7/1949 | Tarrant |
| 2,493,826 | A | 1/1950 | Oelfke |
| 2,595,142 | A | 4/1952 | Herck |
| 2,746,365 | A | 5/1956 | Darneille |
| 2,907,129 | A | 10/1959 | Bedell |
| 2,925,831 | A | 2/1960 | Welty et al. |
| 3,161,442 | A | 12/1964 | Reed |
| 3,319,392 | A | 5/1967 | Fitzgerald |
| 3,334,555 | A | 8/1967 | Nagin et al. |
| 3,441,457 | A | 4/1969 | Regnaud |
| 3,595,143 | A | 7/1971 | Polselli |
| 3,646,715 | A | 3/1972 | Pope |
| 3,737,511 | A | 6/1973 | Dillon |
| 3,797,867 | A | 3/1974 | Hartl |
| 3,815,824 | A | 6/1974 | Olson |
| 3,832,079 | A | 8/1974 | Moorhead |
| 3,874,140 | A | 4/1975 | Seehusen |
| 3,901,615 | A | 8/1975 | Ceintrey |
| 3,910,711 | A | 10/1975 | Moorhead |
| 4,070,128 | A | 1/1978 | Garrison |
| 4,070,849 | A | 1/1978 | DiGiacomo |
| 4,076,875 | A | 2/1978 | Van Gasse |
| 4,115,976 | A | 9/1978 | Rohrer |
| 4,135,840 | A | 1/1979 | Puccini et al. |
| 4,146,599 | A | 3/1979 | Lanzetta |
| 4,175,639 | A | 11/1979 | Wirt |
| 4,205,040 | A | 5/1980 | Aoyama et al. |
| 4,231,677 | A | 11/1980 | Roming |
| 4,270,789 | A | 6/1981 | Cline |
| 4,281,496 | A | 8/1981 | Danielsson |
| 4,443,496 | A | 4/1984 | Obitsu et al. |
| 4,496,504 | A | 1/1985 | Steenson et al. |
| 4,646,482 | A | 3/1987 | Chitjian |
| 4,662,972 | A | 5/1987 | Thompson |
| 4,697,951 | A | 10/1987 | Allen |
| 4,714,507 | A | 12/1987 | Ohgushi |
| 4,748,788 | A | 6/1988 | Shaw et al. |
| 4,776,723 | A | 10/1988 | Brimo |
| 4,838,728 | A | 6/1989 | McKeever |
| 4,915,888 | A | 4/1990 | Sato |
| 5,010,982 | A | 4/1991 | Sedlmayr |
| 5,024,029 | A | 6/1991 | Abbott et al. |
| 5,114,475 | A | 5/1992 | Siegmund et al. |
| 5,215,402 | A | 6/1993 | Stowell et al. |
| 5,226,279 | A | 7/1993 | Rendon-Herrero |
| 5,234,128 | A | 8/1993 | Hill |
| 5,243,905 | A | 9/1993 | Webber |
| 5,244,304 | A | 9/1993 | Weill et al. |
| 5,246,650 | A | 9/1993 | Clark |
| 5,395,673 | A | 3/1995 | Hunt |
| 5,441,677 | A | 8/1995 | Phillips, Sr. |
| 5,447,752 | A | 9/1995 | Cobb |
| 5,492,434 | A | 2/1996 | Adams et al. |
| 5,494,729 | A | 2/1996 | Henry et al. |
| 5,487,526 | A | 3/1996 | Hupp |
| 5,502,941 | A | 4/1996 | Zember et al. |
| 5,645,664 | A | 7/1997 | Clyne |
| 5,733,470 | A | 3/1998 | Roth et al. |
| 5,794,401 | A | 8/1998 | Shaw et al. |
| 5,887,399 | A | 3/1999 | Shaw et al. |
| 5,947,635 | A | 9/1999 | Wilson |
| 5,950,394 | A | 9/1999 | Shaw et al. |
| 6,016,635 | A | 1/2000 | Shaw et al. |
| 6,024,511 | A | 2/2000 | Ross |
| 6,033,146 | A | 3/2000 | Shaw et al. |
| 6,082,074 | A | 7/2000 | Shaw et al. |
| 6,382,871 | B1 | 5/2002 | Ross |
| 6,390,801 | B1 | 5/2002 | Smith |
| 6,444,077 | B1 | 9/2002 | Fennessy |
| 6,528,120 | B2 | 3/2003 | Brown |
| 6,568,146 | B2 | 5/2003 | Harvey |
| 6,588,975 | B2 | 7/2003 | Ross |
| 6,595,768 | B1 * | 7/2003 | Hunsaker ..... 425/385 |
| 6,610,224 | B2 | 8/2003 | Sullivan |
| 6,620,464 | B2 | 9/2003 | Sciandra |
| 6,652,907 | B1 | 11/2003 | Stever |
| 6,779,945 | B2 | 8/2004 | Saffo |
| 6,780,369 | B1 | 8/2004 | Darrow et al. |
| 6,820,383 | B2 | 11/2004 | Vos |
| 7,010,828 | B1 | 3/2006 | Flores et al. |
| 7,051,483 | B2 | 5/2006 | Bamford |
| 7,066,680 | B2 | 6/2006 | Wiley |
| 7,281,878 | B2 | 10/2007 | Schulz |
| 7,322,772 | B2 | 1/2008 | Shaw et al. |
| 7,493,732 | B2 | 2/2009 | Brailsford et al. |
| 7,607,859 | B2 | 10/2009 | Shaw et al. |
| 7,614,820 | B2 | 11/2009 | Shaw et al. |
| 8,079,775 | B2 | 12/2011 | Shaw et al. |
| 8,684,627 | B2 * | 4/2014 | Shaw ..... 404/75 |
| 8,936,411 | B1 * | 1/2015 | Shaw ..... E04B 1/16 264/34 |
| 2003/0140594 | A1 | 7/2003 | Shaw et al. |
| 2003/0227814 | A1 | 12/2003 | Priesnitz et al. |
| 2004/0041295 | A1 | 3/2004 | Shaw et al. |
| 2004/0118025 | A1 | 6/2004 | Shalit |
| 2004/0197548 | A1 | 10/2004 | Kopystecki |
| 2006/0083591 | A1 | 4/2006 | Shaw et al. |
| 2007/0086860 | A1 | 4/2007 | Shaw et al. |
| 2007/0187873 | A1 | 8/2007 | Bailey |
| 2007/0248411 | A1 | 10/2007 | Shaw et al. |
| 2009/0038755 | A1 | 2/2009 | Brailsford et al. |
| 2009/0272068 | A1 | 11/2009 | Shaw et al. |
| 2010/0180528 | A1 | 7/2010 | Shaw |

OTHER PUBLICATIONS

Ardex Inc.; "Self-Leveling Toppings and Underlayments"; 4 pgs.
Schwing America Inc.; "Truck or Trailer Mounted Concrete Pump"; Aug. 1993; 4 pgs.
Mayco Pump Corp.; "The ST Series of Mid Range Concrete Pumps"; 4 pgs.
L.M. Scofield Company; "Lithotex Top Surface Retarder"; 1985; 1 pg.
Concrete Products; "Admixtures"; Apr. 1988; 5 pgs.
Portland Cement Association; "Finishing Concrete Slabs, Exposed Aggregate, Patterns and Colors"; 1979; 9 pgs.
Journal of the American Concrete Institute; "Cement-Aggregate Reaction in Concrete"; Oct. 1947; vol. 19, No. 2; 36 pgs.
Concrete Construction; Cemen-Tech; "Practical, Precise and Profitable Concrete Production Systems"; Aug. 1993; 1 pg.
Margar Ind. Inc.; "No One Beats the Price of the Quick Mix"; 1 pg.
Information Access Co.; "Speciality Concretes"; Jun. 28, 1984; 6 pgs.

* cited by examiner

DECORATIVE CONCRETE AND METHOD OF INSTALLING THE SAME

CROSS-REFERENCE TO RELATED APPLICATIONS

The present application is a continuation patent application of United States patent application Ser. No. 13/595,834 filed on Aug. 27, 2012, which is a continuation patent application of United States patent application Ser. No. 12/357,274 filed on Jan. 21, 2009, the entire contents of which are incorporated herein by reference.

STATEMENT RE: FEDERALLY SPONSORED RESEARCH/DEVELOPMENT

Not Applicable

BACKGROUND

The present invention relates generally to concrete products, and more particularly, to a method of imprinting a visual and textural decorative pattern upon a concrete surface.

As is well known in the building and construction trade, concrete is extensively utilized as a building material for industrial, commercial and residential applications. Due to its durability, water resistance, and cost economy, concrete has gained wide spread use in flooring applications. As a result of wide spread use and popularity, the market is currently demanding concrete surfaces that have an improved aesthetic appeal with limited imperfections and irregularities. Common imperfections include blowholes, or minor lines and cracks that may form while the concrete is cured.

In order to meet this demand, the concrete trade has developed various coloring and surface finishing techniques designed to enhance the aesthetic appeal of concrete surfaces while masking imperfections and irregularities that may exist in the exposed surface areas. An example of such a finishing technique includes push broom finishes. Familiar push brooms such as are commonly used in sweeping floors are pulled across the drying concrete surface, leaving a pattern formed by the bristles as they pass across. Such brooms will ordinarily be found to possess threaded apertures into which a handle with perhaps one or more extensions may be fitted. The resultant bristled appearance provides a generic broom pattern across the concrete surface and serves to hide irregularities and imperfections that may exist thereupon. However, the bristled appearance left by the push brooms is often undesirable as it is not aesthetically pleasing and fails to provide any variations in depth, size, or diameter within the contours of the texture. Additionally, a push broom is increasingly unwieldly and it being the general experience that a push broom is unable to provide a consistent uniform finish across the surface.

Another known method of providing visual and textural effects to a concrete surface is the exposed aggregate method. The exposed aggregate method may be used to diminish the appearance of imperfections within a concrete surface while creating an aesthetically appealing application of concrete. Applicant has conducted extensive research and has developed a variety of methods improving upon the exposed aggregate method, including a variety of surface seeded exposed aggregate products and methods. In particular, several of these methods and products are described in Applicant's U.S. Pat. Nos. 4,748,788, 6,016,635, 6,033,146, and U.S. Patent Publication No. US 2007/02346, the contents of which are incorporated herein by reference.

In a particular surface seeded exposed method, subsequent to pouring the concrete, rock or gravel aggregate is scattered (i.e. broadcasted or seeded) over the top surface of the concrete and subsequently troweled into the same. As the concrete cures, the aggregate becomes adhered to the top surface of the concrete and is thus exposed. Although various sizes of aggregate can be broadcast over the top surface of the concrete in this method, such aggregate is normally of about three-eighths inch diameter or greater in size, and has sheared or jagged edges. The size and shape of the aggregate allows it to be worked into the top surface of the concrete and adequately adhered thereto. Applicant's techniques as described in the above-mentioned patents overcame many of the deficiencies of the prior art and produced improved surface finishes on surface seeded exposed aggregate concrete. In particular, the concrete resultant from practice of the above-mentioned patents exhibits an extremely flat exposed aggregate surface suitable for extremely high traffic flooring applications.

A requisite feature of surface seeded exposed aggregate is the addition of aggregates to the concrete surface. Therefore, there is a need in the art for applying a visual and textural decorative pattern upon a concrete surface capable of concealing imperfections or irregularities thereupon.

BRIEF SUMMARY

According to a preferred embodiment of the present invention, a method of imprinting a visual and textural decorative pattern to an uncured concrete surface is provided. Implementations of the present invention include a concrete product having a surface that models the fine, medium, and/or coarse grain textures of wood, lightly finished cut or honed stone, and the like. Further implementations of the present invention include a concrete product having a surface that incorporates a design pattern featuring any visual or textural pattern in accordance with a pattern imprinted upon a decorative finishing tool. Thus, implementations of the present invention may provide a concrete surface that precisely assimilates the characteristics and colors of wood or stone, including graining, fractures, and/or rock texture properties common in cut or honed stone implemented by utilizing a single finishing tool. Additionally, the unique design pattern serves to shield imperfections and irregularities existing on the concrete surface.

The method generally commences by preparing the concrete surface so that the decorative pattern may be implemented. In this regard, the initial step requires pouring a concrete mixture over the subgrade, with the concrete mixture defining an upper exposed surface when poured. Prior to the concrete mixture being poured thereover, the subgrade is preferably prepared to a desired grade. Such preparation preferably comprises compacting the subgrade to approximately 90% compaction. The compaction of the subgrade may be followed by the placement of a layer of sand thereupon, and the subsequent placement of reinforcement members (e.g., rebar) upon the layer of sand. When the layer of sand and reinforcement members are provided with the prepared subgrade, the concrete mixture is poured over the layer of sand and the reinforcement members such that the reinforcement members are encapsulated therewithin.

After the concrete mixture has been poured, the same is preferably screeded to a desired grade, which is followed by the step of finishing the exposed surface of the concrete mixture with a finishing tool, such as a vibrating metal bull float, to dispose a quantity of cement/fines paste derived from the concrete mixture at the exposed surface thereof. The finishing of the exposed surface via the vibrating metal bull float in this particular step also seals the exposed surface. It is contemplated that this initial finishing step may be completed through the use of either a vibrating magnesium bull float or a vibrating aluminum bull float. The Lievers Holland Company sells a preferred metal bull float under the trademark HAL 200.

It is contemplated that the decorative pattern may be implemented upon all types of concrete surfaces including surface seeded exposed aggregate. If the concrete surface is a surface seeded exposed aggregate then subsequent to the completion of the initial finishing step, a quantity of aggregate is broadcast upon the exposed surface of the concrete mixture. The aggregate may comprise silica sand, glass bead, coarse sand (e.g., Monterey Aquarium coarse sand), organic materials (e.g., sea shells), metals, or composite materials. The aggregate may comprise of particular materials specifically needed to create the sought after pattern. The quantity of aggregate is preferably broadcast over the exposed surface of the concrete mixture at an approximate rate of one pound per square foot of the concrete mixture. It is contemplated that the aggregate selected should carry certain requisite design features sought in the decorative patterns, such as size, color, or reflective qualities.

After being broadcast about the exposed surface of the concrete mixture, the quantity of aggregate is then preferably mixed into the quantity of cement/fines paste through the use of the vibrating metal bull float. As indicated above, the vibrating metal bull float used in the mixing step may comprise either a vibrating magnesium bull float or a vibrating aluminum bull float. Importantly, this mixing step is used to fully embed the quantity of aggregate into the quantity of cement/fines paste.

Subsequent to the initial preparation of the concrete surface, the exposed surface of the concrete mixture is finished with a decorative finishing tool thereby imprinting a decorative pattern on the exposed surface. In this regard, the predetermined pattern may be any visual or textural pattern such as wood grain, or light ground finishes found in cut or honed stone. A decorative finishing tool includes a blade having an impression of the decorative pattern formed thereupon. The blade is then troweled over the exposed surface of the concrete mixture to imprint the decorative pattern upon the exposed surface. The blade may have a custom designed template having protrusions such as rods, or indentations to uniquely form the decorative pattern. It is contemplated that protrusions, such as rods, may be rigidly attached to the blade through conventional means known in the art such as adhesives, welding, or fitting into grooves. It will be appreciated that the decorative pattern may have variations in depth, length, or size while still being formed by a single decorative finishing tool. Thereby, permitting a user to create such an aesthetically pleasing surface without the need for additional manpower.

Upon the implementation of the decorative pattern, the concrete surface is cured. In this regard, it is contemplated that a variety of finishing techniques may be employed specific to the type of concrete being utilized. Resultantly, a concrete surface having an aesthetically appealing visual and textural decorative pattern formed thereupon is provided. It will be appreciated that such a surface may be utilized in high traffic applications and retains the stability and durability features of concrete.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
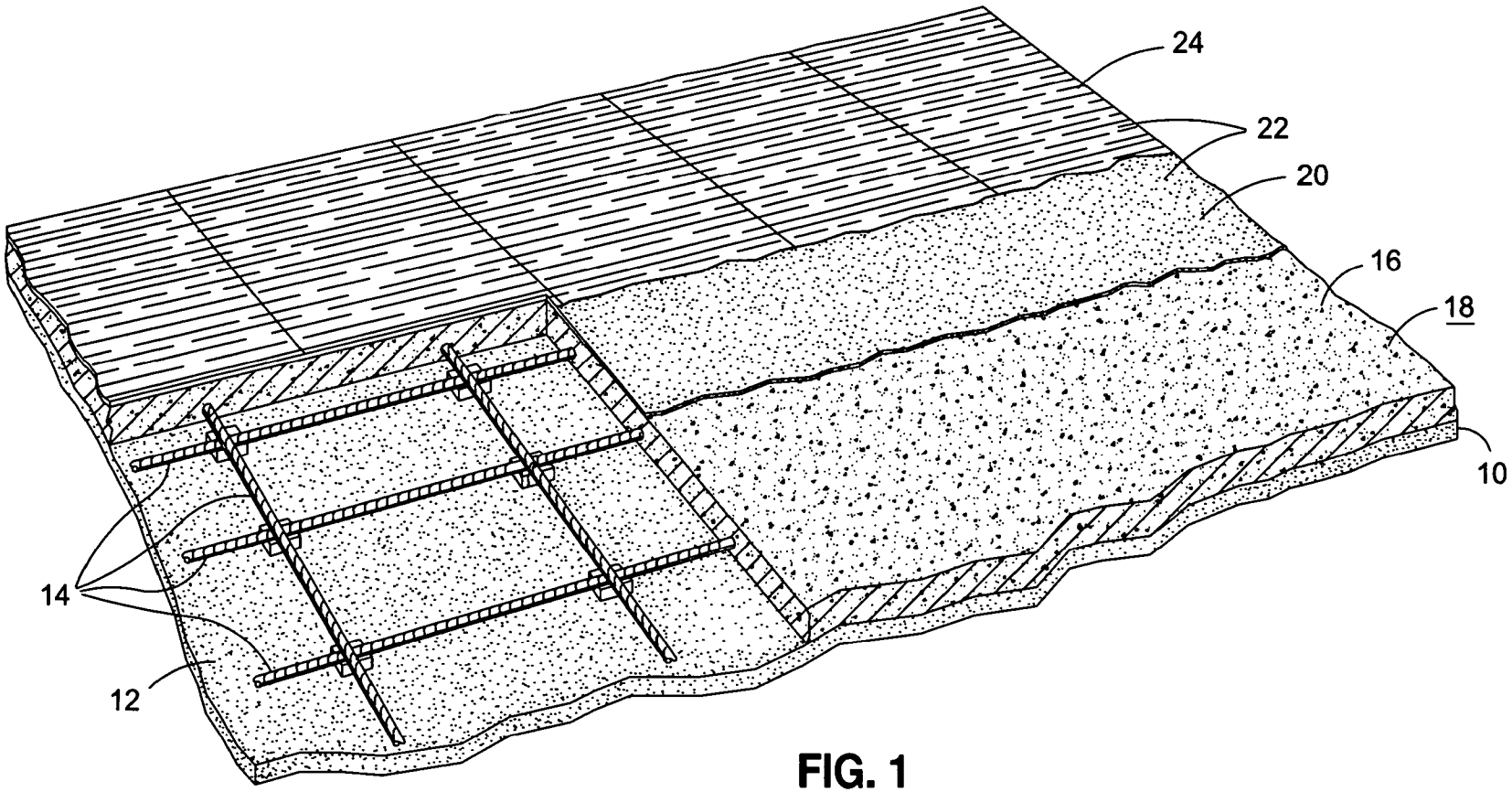
FIG. 1 is a perspective view illustrating stages of preparation of a decorative concrete product produced in accordance with an embodiment of the present invention.

Referring now to FIGS. 1-5, pictorially and schematically illustrating the method transferring a visual and textural design to an uncured concrete surface of a concrete mixture utilizing a decorative finishing tool. The preferred method utilizes a decorative finishing tool to implement a pattern on the exposed surface of the concrete. As a result, the concrete is given an aesthetically pleasing appearance having various depths, sizes, diameters, and length within the contours of the texture thereby resembling natural patterns such as wood grain, or lightly finished cut or honed stone. Additionally, such contours and designs conceal imperfections and irregularities from the concrete surface.

The preferred method commences by preparing the concrete surface. In this regard, the initial step comprises preparing the subgrade 10 to a desired elevation and grade. The subgrade 10 layer of a pavement is, essentially, the native material underneath the pavement. It is also known as the "formation level", which can be defined as the level at which excavation ceases and construction starts, therefore it is the lowest point of the pavement structure. Generally, a subgrade 10 requires some basic preparation for adaptation for construction purposes, this process is known as 'subgrade formation' or 'reducing to level'. Such preparation preferably comprises compacting the subgrade 10 to approximately 90% compaction. Subsequent to being compacted, the subgrade 10 is preferably covered with a layer of clean, moist fill sand 12 which is preferably maintained at a minimum four inch thickness. Although the fill sand 12 is not absolutely necessary for the method of producing the decorative concrete surface of the present invention, it is highly desirable to control the hydration process of the concrete. In order to increase the resultant strength of the concrete and reduce subsequent cracking of the same, reinforcement members 14 such as wire mesh or rebar is/are positioned upon the layer of fill sand 12.

With the reinforcement members 14 in place, a concrete mix or mixture 16 is poured over the layer of fill sand 12 and the reinforcement members 14 such that the reinforcement members 14 are encapsulated therewithin. The concrete mixture 16 is poured to approximately a three and one-half to four inch thickness. Although variations in the concrete mixture 16 are clearly contemplated, a preferred concrete mixture 16 comprises 70% sand and 30% three-eighth inch mean diameter aggregate combined with six sack cement (two thousand pounds per square inch) or seven sack cement (three thousand pounds per square inch). Dependent upon individual desires, various color mixtures can be added to the concrete mixture 16. The color of the concrete mixture 16 may be specifically selected to complement the overall design being implemented in the decorative pattern. It is contemplated that a variety of colors to enhance the effects of the decorative pattern 24 may be employed by the present invention. In the present embodiment of the invention, the decorative pattern 24 implemented on the concrete structure is similar to wood grain. Therefore, the color of the cement mixture 16 may be reflective of wood, taking the color of brown or dark brown or a mixture of colors complementing the desired aesthetic appeal of the decorative pattern 24. It is further contemplated that numerous colors may be employed at various stages of concrete preparation process to obtain varying shades of color if so desired.

After the concrete mixture 16 has been poured, the same is preferably screeded to a desired level plane or grade. Screeding is leveling and smoothing the top layer of the concrete mixture 16, so the mixture 16 is the same height as the forms, or guides, that surround it. The screeding of the concrete mixture 16 results in the same defining a generally level or planar upper exposed surface 18. Therefore in order to facilitate the implementation of the decorative pattern, subsequent to screeding, the exposed surface 18 of the concrete mixture 16 is surfaced or finished with a conventional finishing tool to dispose a quantity of cement/fines paste derived from the concrete mixture 16 at the exposed surface 18 thereof.

In the preferred embodiment, a vibrating metal bull float is utilized as the finishing tool. Such vibrating metal bull floats are known in the art and are characterized by possessing an extremely smooth or polished surface which, in addition to bringing up the appropriate amount of cement/fines paste for the subsequent manipulative steps of the present invention, also tends to seal the exposed surface 18 of the concrete mixture 16. It is contemplated that this initial finishing step may be completed through the use of a conventional bull float. A bull float consists of a trowel blade produced from a specially designed hollow section alloy extrusion with a convex profiled sole. Typically, the blade angle is easily controlled to facilitate forward and backward movement by a blade pitch control. A bull float generally provides very accurate levels without the need for guiding rails. In the present embodiment, it is preferred that either a vibrating magnesium bull float or a vibrating aluminum bull float is utilized. A preferred metal bull float is sold under the trademark HAL 200 by the Lievers Holland company.

According to one aspect of the present invention, when the exposed surface is in the plastic state, fine sand 20 may be broadcast over the exposed surface 18. The fine sand 20 may be of any given color or texture, as required by the decorative pattern 24. Further, it is contemplated that various combinations of color, texture, or other characteristics of the fine sand 20 may be selected in order to complement the decorative pattern 24.

It is contemplated that the present invention may be implemented upon a variety of concrete surfaces, including surface seeded exposed aggregate. Therefore, in an exemplary embodiment of the present invention, a quantity of aggregate 22 may also be broadcast upon the exposed surface 18 of the concrete mixture 16. When the exposed surface 18 of the concrete mixture 16 is still plastic, small size exposed aggregate 22 is broadcast over the exposed surface 18. It is preferred that aggregates 22 be clean, hard, strong particles free of absorbed chemicals or coatings of clay and other fine materials that could cause the deterioration of concrete. The selection of aggregates 22 may impact the aesthetic appearance of the decorative pattern. In this regard, the aggregates 22 are selected to complement the overall visual and textural characteristics of the design pattern.

As a result, a variety of techniques may be employed such that the aggregates 22 carry the desired visual and textural characteristics as required by the decorative pattern 24. In an exemplary embodiment of the present invention, a benefaction process such as jigging or heavy media separation can be used to upgrade the quality of the aggregates 22. In this regard, once processed, the aggregates 22 are handled and stored in a way that minimizes segregation and degradation and prevents contamination. Aggregates 22 not only impact the aesthetic characteristics of concrete but also influence freshly mixed and hardened properties, mixture proportions, and economy of the concrete.

It is preferred that the aggregate 22 comprise silica sand, glass bead, coarse sand (e.g., Monterey Aquarium coarse sand), organic materials (e.g., sea shells), metals, or composite materials. Additionally, it is preferred that any aggregate 22 employed in the present invention be characterized by having a mean average diameter size of approximately one-eighth inch diameter, and further be characterized by possessing a generally rounded external surface configuration. Such small size aggregate 22 is a substantial departure over prior art surface seeded exposed aggregates which typically comprise rock or gravel aggregate having average mean diameters of three-eighths of an inch or greater and are characterized by rough, jagged exterior surfaces. Typically, the aggregate 22 is broadcast over the exposed surface 18 of the concrete mixture 16 by use of square point shovels and is applied at a preferred rate of approximately one pound per square foot of the exposed surface 18 of the concrete mixture 16. It is preferred that the aggregate 22 should not initially depress below the exposed surface 18 of the concrete mixture 16, but rather should be broadcast solely to cover the same.

After being broadcast upon the exposed surface 18 of the concrete mixture 16, the aggregate 22 is mixed or worked into the exposed surface 18 of the concrete mixture 16, and more particularly is mixed into the quantity of cement/fines paste at the exposed surface 18 through the use of the above-described vibrating metal bull float. As indicated above, this vibrating metal bull float may comprise either a vibrating magnesium bull float or a vibrating aluminum bull float. This mixing of the aggregate 22 with the cement/fines paste at the exposed surface 18 derived during the previous vibrating metal bull float step is critical to the process of the present invention and insures that the aggregate 22 is fully embedded into the cement/fines paste, and thus thoroughly adhered or bonded to the exposed surface 18 of the concrete mixture 16 upon resultant curing. In order to maintain the design pattern, it is critical that the aggregate 22 is thoroughly bonded to the exposed surface 18 so that individual pieces of aggregate 22 are not dislodged and impacting the visual and textural effect of the decorative pattern.

Subsequent to the mixing of the aggregate 22 into the cement/fines paste at the exposed surface 18 of the concrete mixture 16, the exposed surface 18 is finished with a decorative finishing tool 26 to implement the decorative pattern 24 upon the exposed surface 18. A decorative finishing tool 26 is a concrete finishing tool that imprints a visual and textural decorative pattern 24 upon the exposed surface 18 of the concrete mixture 16. It is contemplated that the decorative finishing tool 26 may be utilized upon any concrete surface. The decorative finishing tool 26 includes a blade 28 having first and second opposing sides 28*a*, 28*b*. The first opposing side 28*a* is adapted to have a handle 30 or the like so that a user may easily navigate the decorative finishing tool 26 about the exposed surface 18. It is contemplated that the first opposing side 28*a* may carry an insert for employing conventional attachments known in the art such as broom handles and the like. It is further contemplated that the decorative finishing tool 26 may be adapted to work with existing trowels, floats, vibrating floats, and the like.

The second opposing side 28*b* is smoothed or troweled over the exposed surface 18 and imprints the design pattern 24 thereupon. The second opposing side 28*b* is adapted in accordance with the parameters of the design pattern 24 so that the when the decorative finishing tool 26 is troweled over the exposed surface 18, the blade 28 creates the visual and textural design impressions upon the exposed surface 18. It is contemplated that a predetermined template of the design pattern 24 may be formed upon the second opposing side 28*b*. In a preferred embodiment, the second opposing side 28*b* includes a plurality of rods 32 disposed about the second opposing side. The rods 32 are positioned in accordance to the decorative pattern 24 and configured to create the pattern 24 in the exposed surface 18.

In the present embodiment, the decorative pattern 24 is that of wood grain. Generally, natural wood grain finishes include the alignment, texture and appearance of wood fibers. The appearance of natural wood grain varies depending on the sought after look. For example, one wood finish may include grains which runs in a single direction along the cut wood, a product of a straight growing tree. In a second example, a spiral wood grain where grain which develops as the trunk of the tree twists in development may be the sought after look. In order to capture these varying looks, the rods 32 may be constructed so that each rod 32 is varying in linearity, depth, length, and diameter to provide a naturally looking finish. As further illustrated by FIGS. 3 and 4, the rods 32 may be positioned so that there are varying spaces 32 between them which further creates natural finishes found in wood grains.

Figure 2:
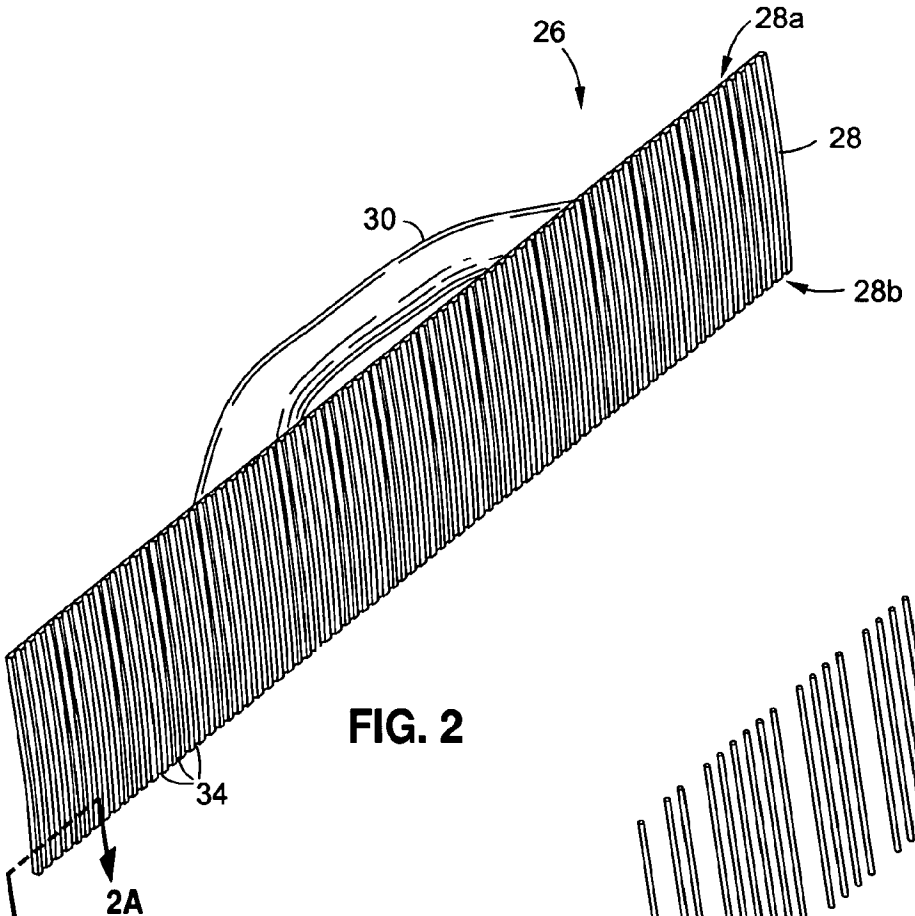
FIG. 2 is a perspective view of a decorative finishing tool having a blade configured with a plurality of grooves for attaching the rods therein.
Figure 3:
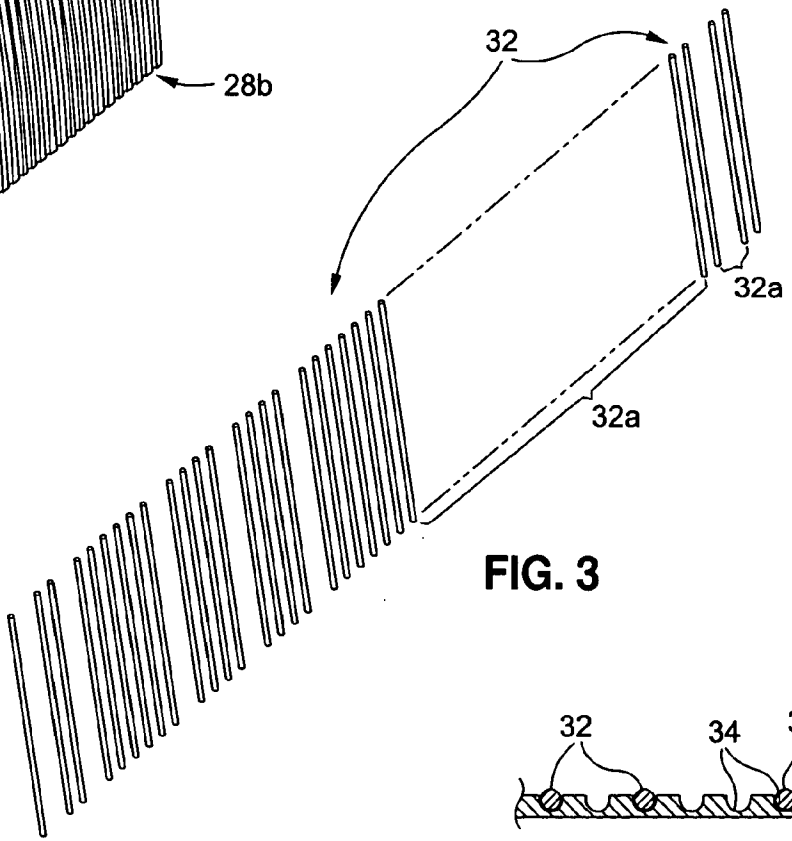
FIG. 3 is a perspective view of the rods configured to attach in the grooves of the blade of the decorative finishing tool; when attached the rods contact the exposed surface and imprint the visual and textural design pattern thereupon.
Figure 4:
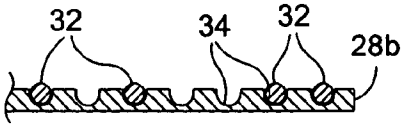
FIG. 4 is a perspective view of the rods rigidly attached to the grooves of the blade of the decorative finishing tool.
Figure 2A:
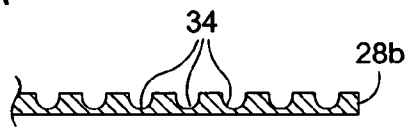
FIG. 2*a* is a section view of the decorative finishing tool illustrating the grooves formed in the blade.
Figure 5:
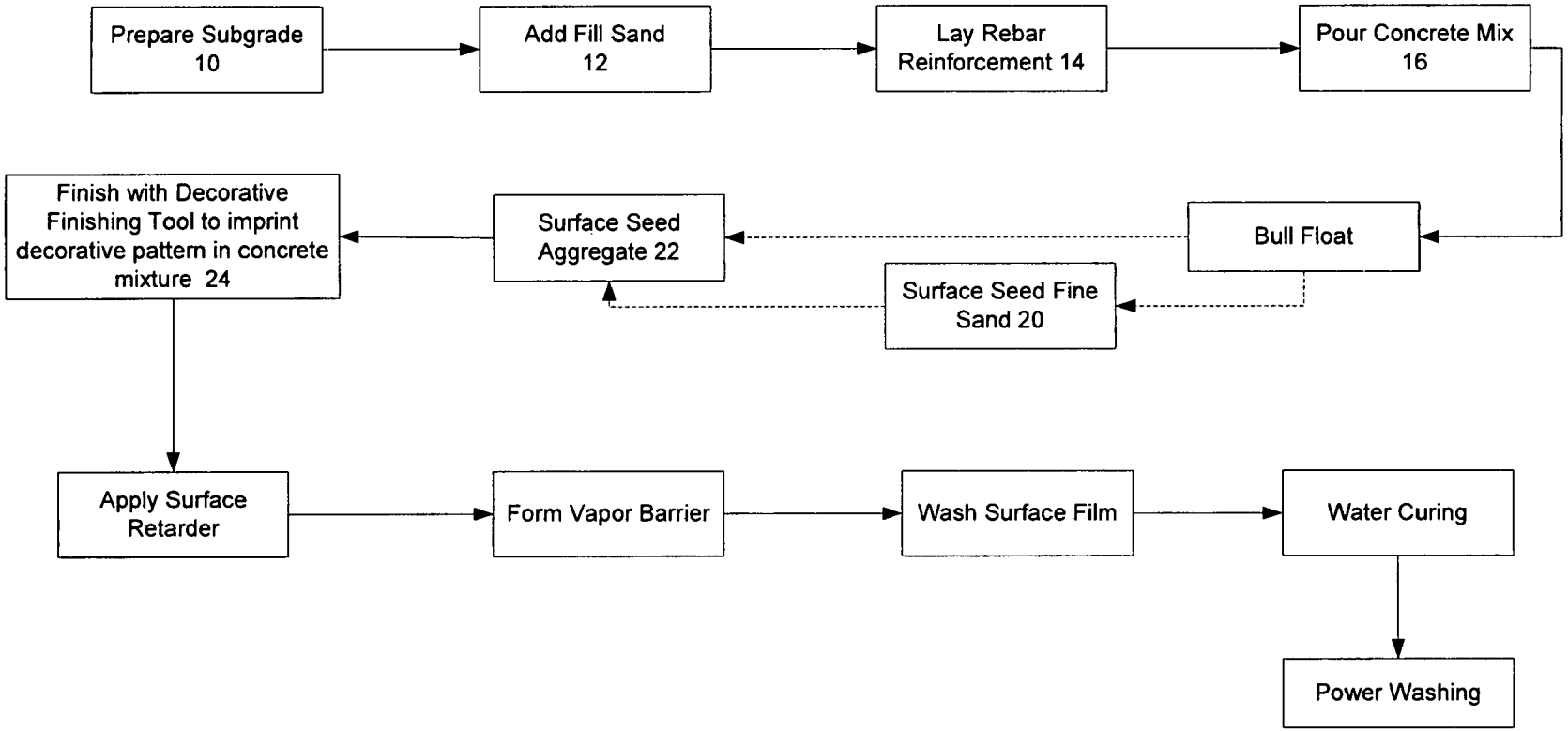
FIG. 5 is schematic diagram illustrating steps of a method for producing the concrete product in accordance with the present invention

It is contemplated that the rods 32 are rigidly affixed to the second opposing side 28*b* so that the construction of the decorative finishing tool 26 can withstand the rigor of imprinting the decorative pattern 24 upon the exposed surface 18. In this regard, the rods 32 may be affixed to the second opposing side 32 through conventional welding techniques or through the use of adhesives such as epoxy or the like. It is preferred that the second side 28*b* is configured with grooves 34 that are adapted to rigidly clasp the rods 32, as illustrated in FIGS. 2, 2*a*, and 4. Therefore, as with the rods 32, each groove 34 may be configured to have a varying length, size, depth, or width to capture the intended design. It is contemplated that conventional concrete-finishing tools such as floats or trowels may be adapted so that a decorative pattern 24 is formed upon conventional blades and configured to implement the decorative pattern 24 upon the exposed surface 18. Prior art finishing tools do not provide such a capability and such a pattern would require utilizing numerous tools to create variations in depth, diameter, size and texture within the concrete. As such, the decorative finishing tool 26 provides the appearance of a multi troweled finish. Additionally, the decorative finishing tool 24 advantageously provides a consistent pattern 24 throughout its application over the entire exposed surface 18.

Once the decorative pattern 24 has been troweled on the exposed surface 18 the concrete may be cured or finished. In certain concrete surfaces a variety of finishing techniques are employed to enhance the stability and durability of the surface. It is contemplated, that the implemented design retains its appearance during the employment of a finishing technique. A common finishing technique utilized with exposed aggregate concrete is the application of a chemical surface retarder. A chemical surface retarder is sprayed upon the exposed surface 18 to uniformly cover the same. The chemical retarder slows down the hydration process of the concrete mixture 16. The chemical retarder does not affect the visual or textural appeal of the decorative pattern 24. The application of the surface retarder to the exposed surface 18 is followed by the step of finishing the exposed surface 18 of the concrete mixture 16 with a conventional finishing tool or a spray to massage the surface retarder into the cement/fines paste having the aggregate 22 mixed therein. This finishing step preferably results in the penetration of the surface retarder into the cement/fines paste a distance of at least approximately three-eighths of an inch which, due to the relatively small size the aggregate 22 therein, is below the maximum depth of the aggregate 22. The chemical retarder slows down the hydration process of the concrete mixture 16. Advantageously, this particular finishing step conducted subsequent to the application of the surface retarder to the exposed surface 18 of the concrete mixture 16 eliminates hard spots in the resultant concrete by facilitating a full mix of the retarder and cement/fines paste.

Subsequent to the surface retarder being massaged into the cement/fines paste, a vapor barrier is preferably formed on the exposed surface 18 of the concrete mixture 16. In the preferred embodiment, the formation of the vapor barrier is facilitated by the application of a liquid chemical evaporation reducer to the exposed surface 18 of the concrete mixture 16. A preferred evaporation reducer is sold under the trademark CONFILM by the Concrete Tie company of Compton, Calif. An alternative vapor barrier may be formed by covering the exposed surface 18 with four or six mill visqueen. The vapor barrier is maintained upon the exposed surface 18 of the concrete mixture 16 for a prescribed period of time, which may range from approximately two to twenty-four hours. The vapor barrier does not affect the visual or textural characteristics of the decorative pattern 24 upon the exposed surface 18.

After the vapor barrier has remained upon the exposed surface 18 for a prescribed period of time, the exposed surface 18 of the concrete mixture 16 is washed with water to remove any surface films therefrom. In this washing procedure, it is additionally preferable to lightly bristle brush the exposed surface 18 wherein preferably no more than about 5% of the aggregate 22 is dislodged and removed therefrom. The extremely low percentage (i.e., less than 5%) removal of the aggregate 22 from the exposed surface 18 evidences the extremely strong adherence of the aggregate 22 to the exposed surface 18 of the concrete mixture 16. It is preferred that brushing the exposed surface 18 is done in a manner to minimize any deviation from the intended visual appeal of the decorative pattern 24.

As a result of the washing step, the full mixture of the retarder and cement/fines paste accomplished through the use of a conventional finishing tool known in the art, such as a trowel or float, subsequent to the application of the surface retarder to the exposed surface 18 of the concrete mixture 16 significantly aides in the elimination of perimeter wear-down and excessive dislodgement and loss of the aggregate 22 during this initial washing step. Which resultantly facilitates the preservation of the decorative pattern 24 upon the exposed surface 18. Additionally, the application of the liquid evaporation reducer to the exposed surface 18 which prevents hydration of the concrete mixture 16 and reduces the rate of evaporation of moisture therefrom increases the ease at which excess cement/fines paste and residual surface retarder are washed from the exposed surface 18 during this initial washing step. In this regard, the aggregate 22 embedded within the decorative pattern 24 is minimally affected.

Subsequent to washing, the concrete mixture 16 is cured with water only as opposed to chemical curing agents to avoid any staining of the same or interference with the visual or textural aesthetics of the design pattern, with such water curing typically being facilitated through the use of a conventional fogger or soaker hose. After a prescribed period of time (e.g., 30 days after initiating the curing process) any surface residue present on the exposed surface 18 is removed by conventional power washing with a 90% steam and 10% muriatic acid mixture which is applied by a power washer via a high pressure nozzle. It is contemplated that conventional power washing of the concrete does not detract from the decorative pattern 24 formed upon the exposed surface 18.

The resultant concrete exhibits an aesthetically appealing surface that conceals imperfections upon the surface and is advantageously suitable for high pedestrian traffic flooring applications. Additionally, the surface color and texture may be such that it approximates conventional flooring surfaces such as stone or wood. This resemblance can further be accentuated by saw cutting the concrete surface into rectangular grids to give the appearance that the individual rectangular squares of the grid were laid in a manner analogous to stone or wood flooring. Thus, the present invention comprises a significant improvement in the art by providing a surface seeded exposed aggregate concrete having a decorative pattern formed thereupon and possesses a surface texture and color having improved aesthetics over the prior art.

Additional modifications and improvements of the present invention may also be apparent to those of ordinary skill in the art. Thus, the particular combination of parts and steps described and illustrated herein is intended to represent only one embodiment of the present invention, and is not intended to serve as limitations of alternative devices and methods within the spirit and scope of the invention.

What is claimed is:

1. A method of imprinting a pattern upon a concrete surface, the method comprising the steps of:

configuring a decorative finishing tool having a blade and a plurality of selectively configurable pattern forming elements selectively arrangeable relative to the blade, the decorative finishing tool being configured by selectively arranging the plurality of selectively configurable pattern forming elements relative to the blade in accordance with a desired pattern; and finishing an exposed surface of a concrete mixture with the decorative finishing tool to imprint the desired pattern upon the exposed surface, at least a portion of the decorative finishing tool being disposed within the concrete mixture and moved within the concrete mixture to create the desired pattern within the concrete mixture.

2. The method of claim 1 wherein after the first finishing step, the method further includes:

broadcasting a quantity of aggregate upon the exposed surface of the concrete mixture;

mixing the quantity of aggregate into a quantity of cement/fines paste;

applying a surface retarder to the exposed surface of the concrete mixture; and finishing the exposed surface of the concrete mixture with a massaging tool to massage the surface retarder into the exposed surface having the desired pattern thereupon.

3. The method of claim 2 wherein the finishing the exposed surface of the concrete mixture with the massaging tool step includes screeding the concrete mixture to a desired grade prior to finishing the exposed surface thereof with the finishing tool.

4. The method of claim 2 further comprising the steps of:

forming a vapor barrier on the exposed surface of the concrete mixture;

washing surface films from the exposed surface of the concrete mixture;

allowing the concrete mixture to harden; and washing the exposed surface of the concrete mixture to remove surface residue therefrom.

5. The method of claim 1 further comprising the steps of:

preparing a subgrade to a desired grade; and pouring the concrete mixture over the prepared subgrade.

6. The method of claim 5 wherein the pouring the concrete mixture over the prepared subgrade step further includes compacting the subgrade to approximately 90% compaction.

7. The method of claim 5 wherein the pouring the concrete mixture over the prepared subgrade step further comprises the steps of:

placing a layer of sand upon the prepared subgrade;

placing reinforcement members upon the layer of sand; and pouring the concrete mixture over the layer of sand and the reinforcement members such that the reinforcement members are encapsulated by the concrete mixture.

8. The method of claim 1 wherein the decorative finishing tool used in the finishing step further includes:

a first opposing side having a handle; and a second opposing side having at least a portion of the decorative pattern formed thereupon, the second opposing side facing the exposed surface of the concrete mixture and configured to imprint the visual and textural decorative pattern on the exposed surface.

9. The method of claim 8 wherein the plurality of pattern forming elements includes a plurality of rods disposable upon the second opposing side, the rods being configured to form the pattern to imprint on the exposed surface of the concrete mixture.

10. The method of claim 9 wherein the rods are adhesively attached to the second opposing side of the blade.

11. The method of claim 9 wherein the rods are welded to the second opposing side of the blade.

12. The method of claim 9 wherein the second opposing side further includes the plurality of grooves formed thereupon, the grooves being positioned in accordance with the visual and textural decorative pattern; and the rods rigidly attached to the grooves.

13. The method of claim 1 wherein the finishing the exposed surface of the concrete mixture with a decorative finishing tool step includes creating a wood grain pattern.

14. The method of claim 1 wherein the finishing the exposed surface of the concrete mixture with a decorative finishing tool step includes creating a cut stone pattern.

15. The method of claim 1 wherein the finishing the exposed surface of the concrete mixture with a decorative finishing tool step includes creating a honed stone pattern.

16. The method of claim 1 wherein the finishing step comprises the step of finishing the exposed surface of the concrete mixture with a vibrating metal bull float.

17. The method of claim 1, wherein the finishing step includes moving the finishing tool in a plane substantially parallel to the exposed surface to create the visual and textural decorative pattern within the concrete.

18. The method of claim 1, wherein the configuring step includes moving at least one of the plurality of pattern forming elements relative to the blade.

* * * * *